US009073076B2

(12) United States Patent
Oshima et al.

(10) Patent No.: US 9,073,076 B2
(45) **Date of Patent: *Jul. 7, 2015**

(54) CAPACITIVE LOAD DRIVING CIRCUIT AND LIQUID EJECTION DEVICE

(71) Applicant: SEIKO EPSON CORPORATION, Tokyo (JP)

(72) Inventors: Atsushi Oshima, Shiojiri (JP); Kunio Tabata, Shiojiri (JP); Noritaka Ide, Shiojiri (JP); Hiroyuki Yoshino, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/282,847

(22) Filed: May 20, 2014

(65) Prior Publication Data

US 2014/0252116 A1 Sep. 11, 2014

Related U.S. Application Data

(63) Continuation of application No. 13/351,770, filed on Jan. 17, 2012, now Pat. No. 8,757,749.

(30) Foreign Application Priority Data

Jan. 18, 2011 (JP) ..... 2011-007556

(51) Int. Cl.

| | |
|---|---|
| ***B41J 29/38*** | (2006.01) |
| ***B05B 12/02*** | (2006.01) |
| ***B41J 2/045*** | (2006.01) |

(Continued)

(52) U.S. Cl.

CPC ..... *B05B 12/02* (2013.01); *B41J 2/04541* (2013.01); *B41J 2/04548* (2013.01); *B41J 2/04581* (2013.01); *B41J 2/17503* (2013.01); *A61J 3/07* (2013.01)

(58) Field of Classification Search

None

See application file for complete search history.

(56) References Cited

U.S. PATENT DOCUMENTS

| | | | |
|---|---|---|---|
| 7,717,530 | B2 | 5/2010 | Oshima |
| 2005/0231179 | A1 | 10/2005 | Ishizaki |
| 2007/0165074 | A1 | 7/2007 | Ishizaki |

(Continued)

FOREIGN PATENT DOCUMENTS

| | | | |
|---|---|---|---|
| JP | 2005-329710 | A | 12/2005 |
| JP | 2007-190708 | A | 8/2007 |

(Continued)

*Primary Examiner* — Geoffrey Mruk
*Assistant Examiner* — Bradley Thies
(74) *Attorney, Agent, or Firm* — Maschoff Brennan

(57) ABSTRACT

A liquid ejection device, includes: a drive waveform signal output circuit which outputs a drive waveform signal to serve as a reference for the drive signal; a modulator which pulse-modulates the drive waveform signal and thus generates a first modulated signal and a second modulated signal having a different phase from the first modulated signal within a range from greater than 90 degrees to smaller than 270 degrees; a first digital power amplifier; a second digital power amplifier a first low pass filter which performs low pass filtering of the first amplified digital signal and thus generates a first demodulated signal; and a second low pass filter which performs low pass filtering of the second amplified digital signal and thus generates a second demodulated signal; wherein the first demodulated signal and the second demodulated signal are combined and applied as the drive signal to the capacitive load.

12 Claims, 11 Drawing Sheets

(51) Int. Cl.
*B41J 2/175* (2006.01)
*A61J 3/07* (2006.01)

(56) References Cited

U.S. PATENT DOCUMENTS

| | | | |
|---|---|---|---|
| 2008/0018686 | A1 | 1/2008 | Oshima et al. |
| 2008/0170090 | A1 | 7/2008 | Oshima |
| 2009/0195576 | A1 | 8/2009 | Oshima |
| 2009/0213153 | A1 | 8/2009 | Tabata et al. |
| 2009/0303271 | A1 | 12/2009 | Tabata et al. |
| 2010/0045714 | A1 | 2/2010 | Ishizaki |
| 2011/0109674 | A1 | 5/2011 | Oshima et al. |

FOREIGN PATENT DOCUMENTS

| | | | |
|---|---|---|---|
| JP | 2008-049698 | A | 3/2008 |
| JP | 2008-188985 | A | 8/2008 |
| JP | 2009-061671 | A | 3/2009 |
| JP | 2009-166349 | A | 7/2009 |
| JP | 2010-046989 | A | 3/2010 |
| JP | 2010-173184 | A | 8/2010 |
| JP | 2011-101972 | A | 5/2011 |
| WO | 2007/072945 | A1 | 6/2007 |

CAPACITIVE LOAD DRIVING CIRCUIT AND LIQUID EJECTION DEVICE

CROSS-REFERENCE TO RELATED APPLICATIONS

This application is a Continuation of U.S. application Ser. No. 13/351,770, filed Jan. 17, 2012 which claims priority to Japanese Patent Application No. 2011-007556 filed on Jan. 18, 2011. The foregoing patent applications are incorporated herein by reference.

BACKGROUND

1. Technical Field

The present invention relates to a technique of applying a drive signal to and thus driving a capacitive load such as a piezoelectric element.

2. Related Art

There are a number of piezoelectric elements driven by application of a predetermined drive signal, such as an ejection head installed in an inkjet printer. To drive such piezoelectric elements, usually a drive waveform signal is power-amplified and then applied as a drive signal to the piezoelectric elements.

As a method for power-amplifying a drive waveform signal, for example, a method using a class-D amplifier is known (JP-A-2005-329710 and the like). In this method, power amplification is carried out after a drive waveform signal is pulse-modulated and thus converted to a pulse wave-like modulated signal. Both a pulse width modulation (PWM) system and a pulse density modulation (PDM) system can be applied as pulse modulation systems, but pulse width modulation is usually used. Then, after the resulting pulse wave-like modulated signal is power-amplified and thus converted to a pulse wave-like modulated signal that changes between a power-supply voltage and a ground (amplified digital signal), a modulation component is eliminated by a low pass filter, thus generating an amplified drive waveform signal (drive signal).

Here, a high frequency having a margin in relation to a frequency band of the drive signal is set as a cutoff frequency of the low pass filter so that elimination of a signal component of the drive signal can be prevented during the elimination of the modulation component by the low pass filter. Moreover, in order to enable complete elimination of the modulation component resulting from the pulse modulation by the low pass filter, a high frequency having a margin in relation to the cutoff frequency of the low pass filter is set as a carrier frequency at the time of the pulse modulation. Consequently, in the class-D amplifier, for example, a carrier frequency that is higher than the frequency band of the drive signal by ten times or more is used.

However, if the frequency band of the drive signal includes a high frequency band, there is a problem that a very high frequency must be set as the carrier frequency when power amplification is to be carried out using the class-D amplifier. For example, a drive signal of an ejection head installed in an inkjet printer has a frequency component of 500 kHz or higher and therefore a high frequency of 5 MHz or higher needs to be set as the carrier frequency. This has adverse effects, for example, operation of a switching element cannot catch up or increase in power loss for switching lowers power efficiency. Although using a high-order low pass filter may be possible in order to obtain sharp filter properties, there are problems not only that the configuration of the low pass filter becomes complex, but also that high-order transmission properties may cause a strain in the drive signal in relation to high frequency bands and fluctuations in load.

SUMMARY

An advantage of some aspects of the invention is that a technique that enables driving of a capacitive load by applying a drive signal containing a high frequency band while restraining a carrier frequency of a class-D amplifier to a low frequency is provided.

An aspect of the invention is directed to a capacitive load driving circuit in which a predetermined drive signal is applied to a capacitive load and the capacitive load is thus driven. The capacitive load driving circuit includes: a drive waveform signal output circuit which outputs a drive waveform signal to serve as a reference for the drive signal; a modulator which pulse-modulates the drive waveform signal and thus generates a first modulated signal and a second modulated signal having a different phase from the first modulated signal; a first digital power amplifier which power-amplifies the first modulated signal and thus generates a first amplified digital signal; a second digital power amplifier which power-amplifies the second modulated signal and thus generates a second amplified digital signal; a first low pass filter which performs low pass filtering of the first amplified digital signal and thus generates a first demodulated signal; and a second low pass filter which performs low pass filtering of the second amplified digital signal and thus generates a second demodulated signal; wherein the first demodulated signal and the second demodulated signal are combined and applied as the drive signal to the capacitive load.

In the capacitive load driving circuit according to the above aspect of the invention, a drive signal is applied to a capacitive load in the following manner. First, a drive waveform signal to serve as a reference for the drive signal is pulse-modulated, thus generating a first modulated signal and a second modulated signal having a different phase from the first modulated signal. Then, the first modulated signal is power-amplified to generate a first amplified digital signal, and the second modulated signal is power-amplified to generate a second amplified digital signal. Subsequently, the first amplified digital signal is low-pass-filtered by a first low pass filter, thus generating a first demodulated signal. The second amplified digital signal is low-pass-filtered by a second low pass filter, thus generating a second demodulated signal. After that, the first demodulated signal and the second demodulated signal are combined and applied as the drive signal to the capacitive load.

Generally, if a carrier frequency at the time of pulse modulation is not set to a sufficiently high frequency in relation to a cutoff frequency of the low pass filter, a ripple current of the carrier frequency is superimposed on the drive signal after passing through the low pass filter. Since the cutoff frequency of the low pass filter must be set to a higher frequency than a frequency band of the drive signal, the carrier frequency at the time of pulse modulation tends to be high accordingly. Particularly, if the frequency band of the drive signal contains a high frequency band, the carrier frequency must be set to a very high frequency, causing adverse effects, of example, operation of a switching element cannot catch up or increase in power loss for switching lowers power efficiency. Meanwhile, in the capacitive load driving circuit according to the above aspect of the invention, amplified digital signals having different phases from each other are low-pass-filtered and outputs after the low pass filtering are combined into one and then applied as the drive signal to the capacitive load. Therefore, even if ripple currents are left in the outputs after the low pass filtering, the ripple current superimposed on each output has a different phase from each other, and combining the outputs offset each other's ripple current. Thus, the ripple current superimposed on the drive signal can be reduced. Therefore, even when a drive signal having a high frequency band is applied, the drive signal with reduced ripple current can be generated while the carrier frequency at the time of pulse modulation is restrained to a relatively low frequency. Thus, the capacitive load can be driven properly. Moreover, since the carrier frequency can be restrained to a relatively low frequency, the adverse effects, such as the operation of the switching element being unable to catch up or reduction in power efficiency due to increase in power loss for switching, are not generated.

In the capacitive load driving circuit according to the above aspect of the invention, the second modulated signal may have a phase different from the first modulated signal within a range from greater than 90 degrees (excluding 90 degrees) to smaller than 270 degrees (excluding 270 degrees).

If the phases of the plural modulated signals are made different from each other within such a range, when the outputs after passing through the low pass filters are combined, the ripple currents superimposed on the outputs can offset each other. Consequently, even when a drive signal having a high frequency is applied, the drive signal with reduced ripple current can be generated while the carrier frequency at the time of pulse modulation is restrained to a relatively low frequency. Thus, the capacitive load can be driven properly. When the phases of the modulated signals are made different from each other particularly by 180 degrees, within the range from 90 degrees to 270 degrees, the ripple current when the outputs after passing through the low pass filters are combined can be restrained to a minimum level.

In the capacitive load driving circuit according to the above aspect of the invention, a first triangular wave signal and the drive waveform signal may be compared with each other to generate the first modulated signal, and a second triangular wave signal having a different phase from the first triangular wave signal and the drive waveform signal may be compared with each other to generate the second modulated signal.

Thus, the first modulated signal and the second modulated signal having different phases from each other can be generated easily.

In the capacitive load driving circuit according to the above aspect of the invention, the first modulated signal and the second modulated signal may be generated in the following manner. First, the drive waveform signal is pulse-modulated to generate the first modulated signal. Also, a reverse drive waveform signal obtained by reversing the drive waveform signal may be generated, and the reverse drive waveform signal may be pulse-modulated to generate the second modulated signal.

Thus, even without preparing plural triangular wave signals, the first modulated signal and the second modulated signal can be generated easily by pulse-modulating the drive waveform signal and the reverse drive waveform signal obtained by reversing the drive waveform signal.

Alternatively, in the capacitive load driving circuit according to the above aspect of the invention, the first modulated signal and the second modulated signal may be generated in the following manner. First, the drive waveform signal is pulse-modulated to generate the first modulated signal. Next, the first modulated signal is delayed to generate the second modulated signal.

Thus, the second modulated signal can be easily generated simply by delaying the first modulated signal.

The capacitive load driving circuit according to the above aspect of the invention may be installed in a liquid ejection device.

As a drive signal applied to a capacitive load in order for the liquid ejection device to eject a liquid, a drive signal containing a high frequency band is often used. Therefore, by providing the capacitive load driving circuit according to the above aspect of the invention in the liquid ejection device, the drive signal with reduced ripple current can be applied to the capacitive load so that the liquid can be ejected, while the carrier frequency at the time of pulse modulation is restrained to a low frequency.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, to clarify the contents of the invention, embodiments will be described in the following order.

A. First Embodiment

A-1. Device Configuration

A-2. Circuit Configuration of Capacitive Load Driving Circuit

A-3. Operation of Capacitive Load Driving Circuit

B. Second Embodiment

C. Third Embodiment

D. Modification

A. First Embodiment

A-1. Device Configuration

Figure 1:
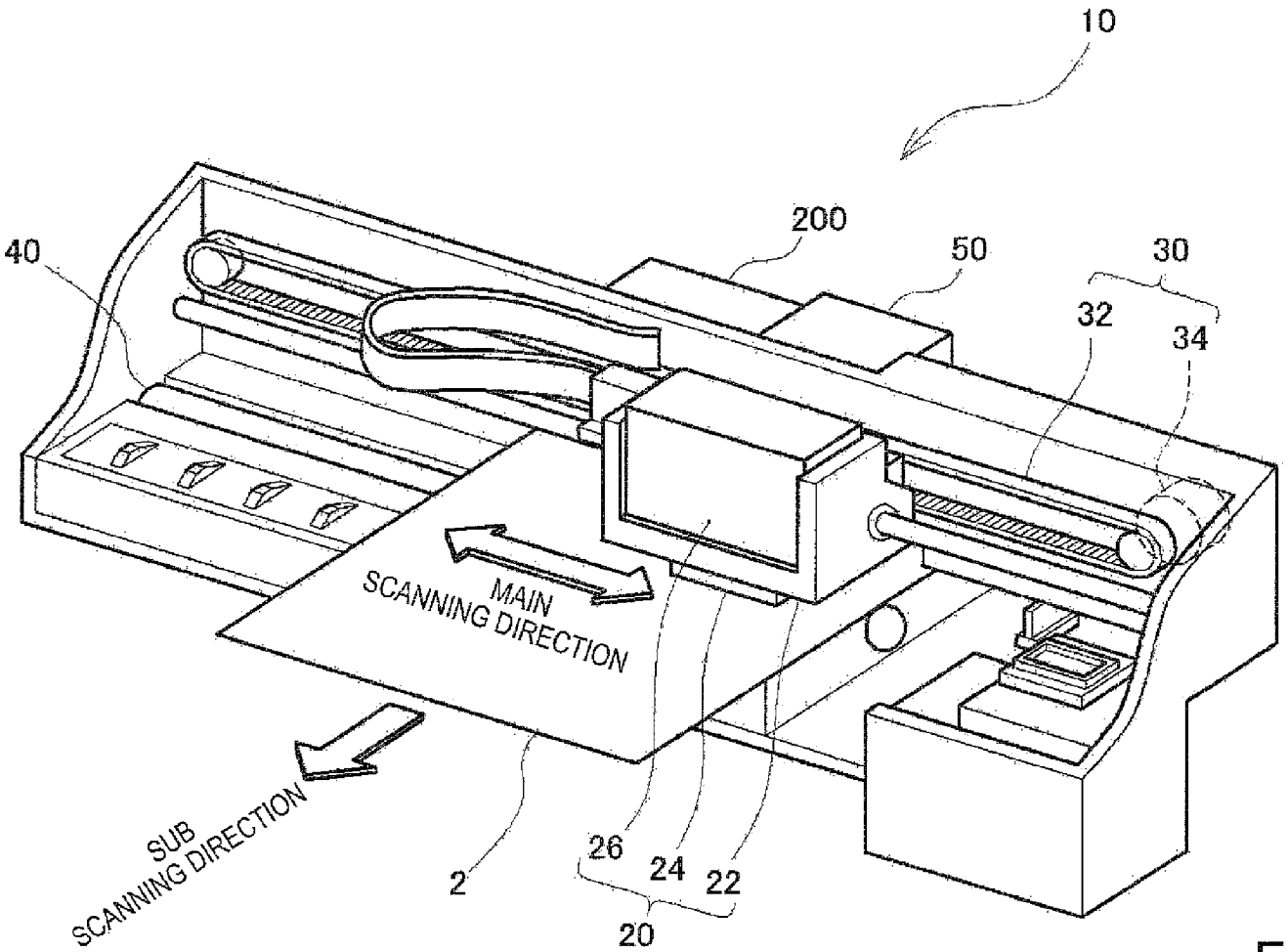
FIG. 1 is an explanatory view illustrating an inkjet printer in which a capacitive load driving circuit according to an embodiment is installed.

FIG. 1 is an explanatory view illustrating an inkjet printer 10 in which a capacitive load driving circuit 200 of a first embodiment is installed. The illustrated inkjet printer 10 includes a carriage 20 which forms ink dots on a print medium 2 while reciprocating in a main scanning direction, a drive mechanism 30 which reciprocates the carriage 20, a platen roller 40 for feeding the print medium 2, and the like. The carriage 20 is provided with an ink cartridge 26 housing an ink, a carriage case 22 in which the ink cartridge 26 is loaded, an ejection head 24 which is installed on a bottom side of the carriage case 22 (a side facing the print medium 2) and ejects the ink, and the like. The ink in the ink cartridge 26 is led to the ejection head 24, and the ink is ejected to the print medium 2 from the ejection head 24, thus printing an image.

The drive mechanism 30, which reciprocates the carriage 20, includes a timing belt 32 stretched by a pulley, a step motor 34 which drives the timing belt 32 via the pulley, and the like. A portion of the timing belt 32 is fixed to the carriage case 22, and as the timing belt 32 is driven, the carriage case 22 can be reciprocated. The platen roller 40 constitutes a sheet feeding mechanism for feeding the print medium 2 together with a drive motor and a gear mechanism, not shown, and thus can feed the print medium 2 in a sub scanning direction by a predetermined amount each time.

In the inkjet printer 10, a printer control circuit 50 which controls overall operation of the printer, and the capacitive load driving circuit 200 for driving the ejection head 24 are installed as well. The printer control circuit 50 controls the overall operation of the printer in which the ejection head 24 is driven to eject the ink while the capacitive load driving circuit 200, the drive mechanism 30, the sheet feeding mechanism and the like feed the print medium 2.

Figure 2:
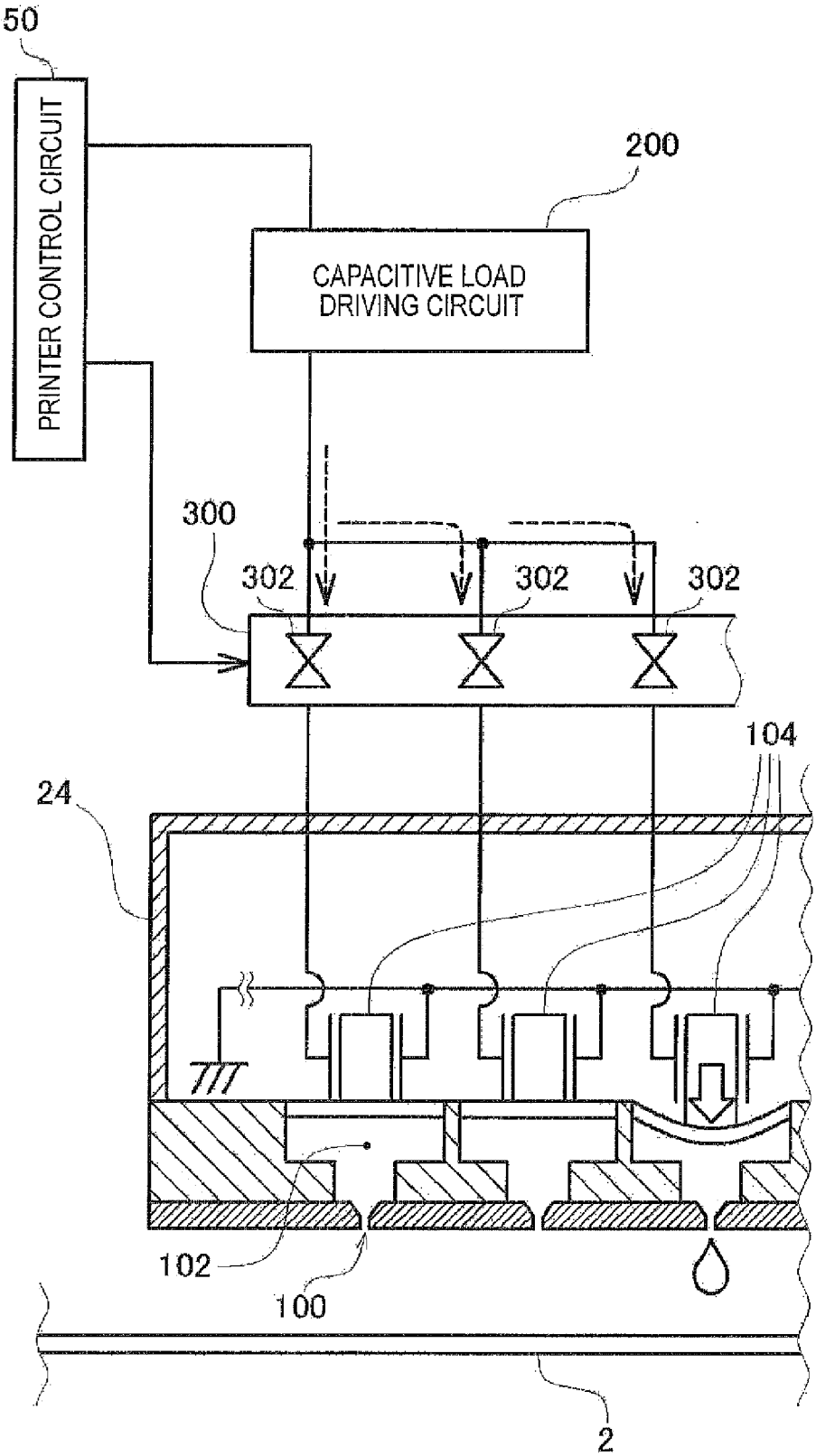
FIG. 2 is an explanatory view showing the state where the capacitive load driving circuit drives an ejection head under the control of a printer control circuit.

FIG. 2 is an explanatory view showing the state where the capacitive load driving circuit 200 drives the ejection head 24 under the control of the printer control circuit 50. First, the internal structure of the ejection head 24 will be briefly described. As illustrated, a bottom side of the ejection head 24 (a side facing the print medium 2) is provided with plural ejection ports 100 for ejecting ink droplets. Each ejection port 100 is connected to an ink chamber 102. The ink chamber 102 is filled with the ink supplied from the ink cartridge 26. A piezoelectric element 104 is provided above each ink chamber 102. As a drive signal (hereinafter simply referred to as COM) is applied to the piezoelectric element 104, the piezoelectric element becomes deformed and pressurizes the ink chamber 102, thus causing the ink to be ejected from the ejection port 100. In the first embodiment, the piezoelectric element 104 is equivalent to a "capacitive load" according to the invention.

COM (drive signal) applied to the piezoelectric element 104 is generated by the capacitive load driving circuit 200 and supplied to the piezoelectric element 104 via a gate unit 300. The gate unit 300 is a circuit unit in which plural gate elements 302 are connected in parallel. Each gate element 302 can be separately electrically connected or disconnected under the control of the printer control circuit 50. Therefore, COM outputted from the capacitive load driving circuit 200 passes only through the gate element 302 that is preset as electrically connected by the printer control circuit 50, and is thus applied to the corresponding piezoelectric element 104. The ink is ejected from the corresponding ejection port 100.

A-2. Circuit Configuration of Capacitive Load Driving Circuit

Figure 3:
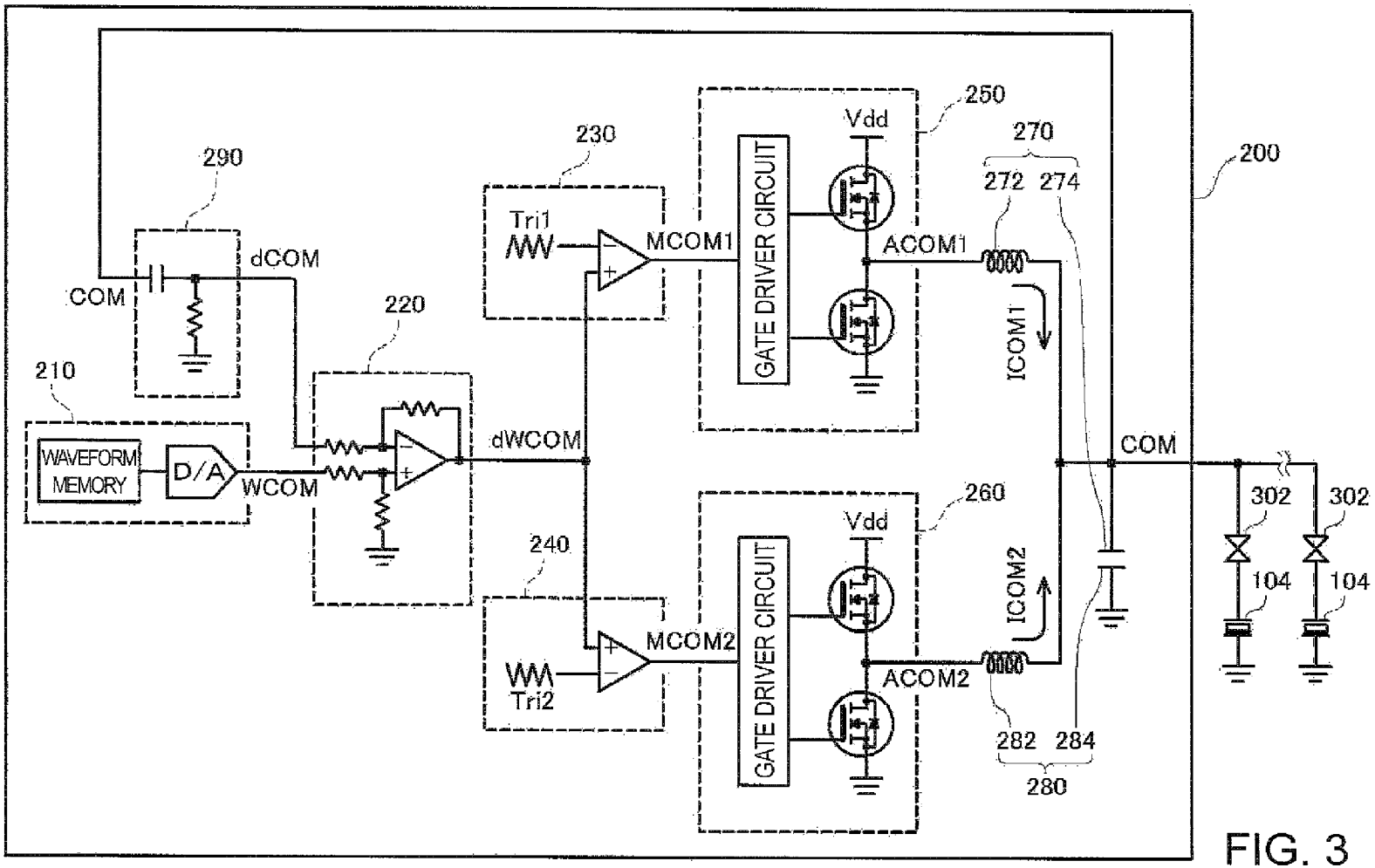
FIG. 3 is an explanatory view showing the detailed configuration of a capacitive load driving circuit of a first embodiment.

FIG. 3 is an explanatory view showing the detailed configuration of the capacitive load driving circuit 200 of the first embodiment. As illustrated, the capacitive load driving circuit 200 includes a drive waveform signal output circuit 210, an arithmetic circuit 220, a first modulator 230 and a second modulator 240, a first digital power amplifier 250 and a second digital power amplifier 260, a first low pass filter 270 and a second low pass filter 280, a compensation circuit 290, and the like.

Of these components, the drive waveform signal output circuit 210 includes a waveform memory and a D/A converter. The waveform memory stores data of a drive waveform signal (hereinafter simply referred to as WCOM) that serves as the base of COM for driving the piezoelectric element 104 (capacitive load). This data is converted to an analog signal by the D/A converter and outputted as WCOM.

The arithmetic circuit 220 is provided with a positive input terminal and a negative input terminal. WCOM from the drive waveform signal output circuit 210 is inputted to the positive input terminal. A feedback signal formed by phase compensation of COM applied to the piezoelectric element 104 (hereinafter simply referred to as dCOM) is inputted to the negative input terminal. The arithmetic circuit 220 then performs differential amplification between WCOM and dCOM and outputs an error signal (hereinafter simply referred to as dWCOM).

dWCOM is inputted to the first modulator 230 and the second modulator 240. In the first modulator 230 and the second modulator 240, dWCOM is inputted to the positive input terminals and triangular wave signals Tri1 (a first triangular wave signal) and Tri2 (a second triangular wave signal) are inputted to the opposite negative input terminals. The first modulator 230 and the second modulator 240 compare these inputs and thus perform pulse width modulation. Here, in the first modulator 230 and the second modulator 240, the same triangular wave repetition frequency (carrier frequency) is used, but the triangular wave signals Tri1, Tri2 have different phases from each other by 180 degrees. A modulated signal outputted from the first modulator 230 is hereinafter referred to as a first modulated signal or simply MCOM1. A modulated signal outputted from the second modulator 240 is hereinafter referred to as a second modulated signal or simply MCOM2.

MCOM1 outputted from the first modulator 230 is inputted to the first digital power amplifier 250. The first digital power amplifier 250 includes two switch elements (MOSFETs or the like) which are push-pull connected, a power source, and a gate driver which drives these switch elements. If MCOM1 is in high state, the switch element on a high side is ON and the switch element on a low side is OFF. A voltage Vdd of the power source is outputted as an amplified digital signal. The amplified digital signal outputted from the first digital power amplifier 250 is hereinafter referred to as a first amplified digital signal or simply ACOM1. If MCOM1 is in low state, the switch element on the high side is OFF and the switch element on the low side is ON. A ground voltage is outputted as ACOM1.

MCOM2 outputted from the second modulator 240 is similarly power-amplified and converted to an amplified digital signal by the second digital power amplifier 260. The amplified digital signal outputted from the second digital power amplifier 260 is hereinafter referred to as a second amplified digital signal or simply ACOM2. That is, the second digital power amplifier 260 similarly includes two switch elements (MOSFETs or the like) which are push-pull connected, a power source, and a gate driver which drives these switch elements. If MCOM2 is in high state, a voltage Vdd of the power source is outputted as ACOM2. If MCOM2 is in low state, aground voltage is outputted as ACOM2. ACOM1, ACOM2, thus amplified, are inputted to the first low pass filter 270 and the second low pass filter 280, respectively.

The first low pass filter 270 includes a coil 272 and a capacitor 274. The second low pass filter 280 similarly includes a coil 282 and a capacitor 284. Here, the coil 272 and the coil 282 are set at the same inductance value. In this embodiment, one capacitor is shared as the capacitor 274 and the capacitor 284.

The first low pass filter 270 demodulates ACOM1 from the first digital power amplifier 250. The second low pass filter 280 demodulates ACOM2 from the second digital power amplifier 260. The demodulated signals are combined and applied as COM (drive signal) to the piezoelectric element 104 (capacitive load). The demodulated signal outputted from the first low pass filter 270 is hereinafter referred to as a first demodulated signal or simply ICOM1. The demodulated signal outputted from the second low pass filter 280 is hereinafter referred to as a second demodulated signal or simply ICOM2. COM is subject to phase lead compensation by the compensation circuit 290 including a capacitor and a resistor, and then inputted to the negative terminal of the arithmetic circuit 220 as dCOM. Thus, as the demodulated signal ICOM1 from the first low pass filter 270 and the demodulated signal ICOM2 from the second low pass filter 280 are combined to generate COM, COM including a high frequency band can be generated while the carrier frequencies of the triangular wave signals Tri1, Tri2 are restrained to low. Hereinafter, the operation of the capacitive load driving circuit 200 of the first embodiment will be described mainly in terms of this feature.

A-3. Operation of Capacitive Load Driving Circuit

Figure 4A:
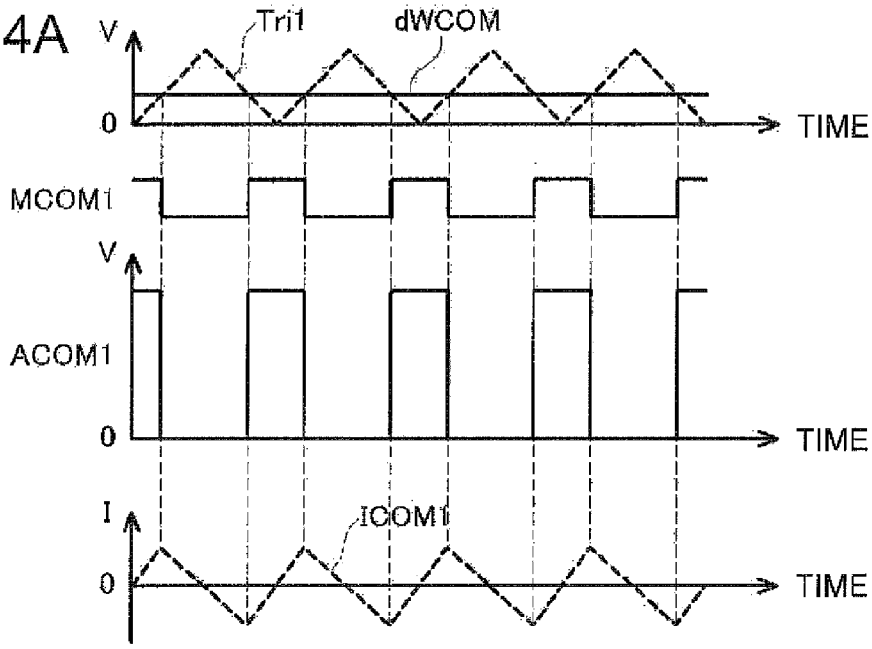
FIGS. 4A to 4C are explanatory views showing the state where the capacitive load driving circuit of the first embodiment combines two demodulated signals to generate a drive signal.
Figure 4B:
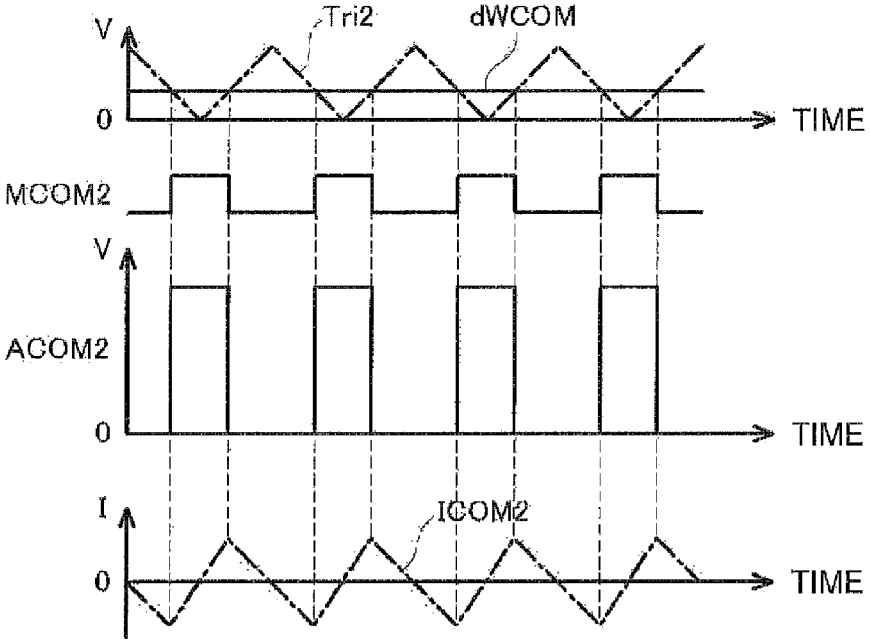
Figure 4C:
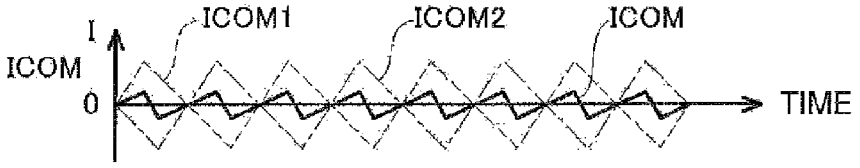

FIGS. 4A to 4C are explanatory views showing the state where the capacitive load driving circuit 200 of the first embodiment combines two demodulated signals to generate COM. FIG. 4A shows the operation of the first modulator 230, the first digital power amplifier 250 and the first low pass filter 270. FIG. 4B shows the operation of the second modulator 240, the second digital power amplifier 260 and the second low pass filter 280. FIG. 4C shows the state where two demodulated signals are combined.

As is clear from the comparison between the triangular wave signal Tri1 shown in FIG. 4A and the triangular wave signal Tri2 shown in FIG. 4B, the triangular wave signals Tri1, Tri2 have different phases from each other by 180 degrees. Therefore, despite the same dWCOM is inputted to the first modulator 230 and the second modulator 240, the resulting MCOM1, MCOM2 have different phases from each other by 180 degrees. MCOM1, MCOM2 are power-amplified by the first digital power amplifier 250 and the second digital power amplifier 260, respectively, and thus converted to ACOM1, ACOM2, and then inputted to the coil 272 and the coil 282.

Here, the current ICOM1 flowing through the coil 272 gradually increases during a period when the voltage of ACOM1 is at a high value, and gradually decreases during a period when the voltage of ACOM1 is at a low value. Therefore, ICOM1 becomes a ripple current as shown in the bottom of FIG. 4A. Here, the ripple current means a current component which increases and decreases with the carrier frequency of the triangular wave signal Tri1 (or Tri2). Similarly, the current ICOM2 flowing through the coil 282 becomes a ripple current as shown in the bottom of FIG. 4B. If such a ripple current is superimposed on COM applied to the piezoelectric element 104 (capacitive load), the ripple current causes the piezoelectric element 104 to vibrate and therefore it is difficult to drive the piezoelectric element 104 properly. The ripple current also consumes power. Moreover, a cable for supplying COM to the piezoelectric element 104 (capacitive load) radiates electromagnetic noise, which can cause malfunction of peripheral devices.

However, in the capacitive load driving circuit 200 of the first embodiment, since the triangular wave signals Tri1, Tri2 having different phases from each other by 180 degrees are used for pulse modulation, the ripple currents flowing through the coil 272 and the coil 282 have different phases from each other by 180 degrees. Consequently, as the signal passed through the coil 272 and the signal passed through the coil 282 are combined, the ripple currents superimposed on these signals offset each other. Thus, the ripple current can be reduced as indicated by a solid line in FIG. 4C. That is, even if the modulation component from the first digital power amplifier 250 cannot sufficiently eliminated by the first low pass filter 270 and therefore the ripple current is left, and similarly, even if the modulation component from the second digital power amplifier 260 cannot sufficiently eliminated by the second low pass filter 280 and therefore the ripple current is left, the ripple currents can be reduced by combining the demodulated signals from the first low pass filter 270 and the second low pass filter 280. Thus, since all the modulation components (carrier components) need not necessarily eliminated by the low pass filters, the carrier frequencies can be set to relatively low frequencies compared with the related art. Moreover, the reduction in the ripple current superimposed on COM directly means the reduction in noise of high frequency components. Therefore, stability in feedback control can be improved.

In the first embodiment, the first modulator 230 and the second modulator 240 perform pulse modulation of the same dWCOM, using the triangular wave signals Tri1, Tri2 having different phases from each other by 180 degrees. Therefore, the ripple current superimposed on the current ICOM1 passed through the coil 272 and the ripple current superimposed on the current ICOM2 passed through the coil 282 have different phases from each other by 180 degrees and therefore the ripple currents offset each other efficiently. Thus, the ripple currents can be reduced efficiently.

Moreover, the first digital power amplifier 250 and the second digital power amplifier 260 perform power amplification with the same gain. The coil 272 and the coil 282 are set at the same inductance value. Therefore, the ripple current of the current ICOM1 passed through the coil 272 and the ripple current of the current ICOM2 passed through the coil 282 offset each other efficiently. Thus, the ripple currents can be reduced efficiently.

In the first embodiment, the triangular wave signal Tri1 and the triangular wave signal Tri2 are described as having different phases from each other by 180 degrees. However, the phase difference between the triangular wave signal Tri1 and the triangular wave signal Tri2 need not necessarily be 180 degrees. Any phase difference greater than 90 degrees (over 90 degrees) and smaller than 270 degrees (under 270 degrees) can be used.

Figure 5:
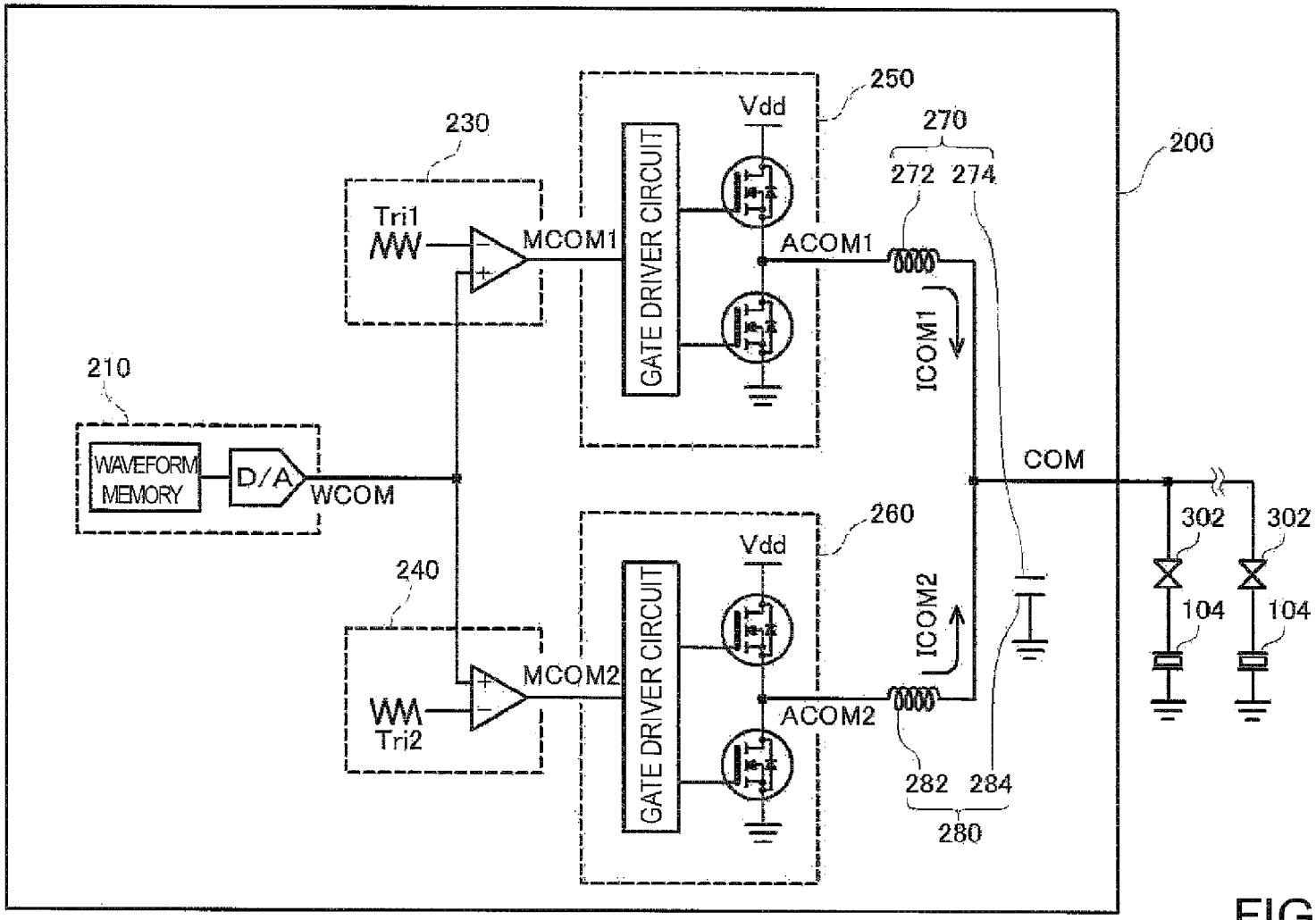
FIG. 5 is an explanatory view showing the detailed configuration of another form of the capacitive load driving circuit of the first embodiment.

In the first embodiment, COM applied to the piezoelectric element 104 is described as being fed back to the arithmetic circuit 220 via the compensation circuit 290. However, a configuration without feedback of COM may also be employed, as illustrated in FIG. 5.

B. Second Embodiment

In the first embodiment, two modulated signals (MCOM1, MCOM2) are generated by pulse modulation of dWCOM using two triangular wave signals Tri1, Tri2 having different phases from each other. However, two modulated signals (MCOM1, MCOM2) can be generated using one triangular wave signal Tri1. Hereinafter, a second embodiment of such configuration will be described. In the second embodiment, components similar to those described in the first embodiment are denoted by the same reference numerals as in the first embodiment and will not be described further in detail.

Figure 6:
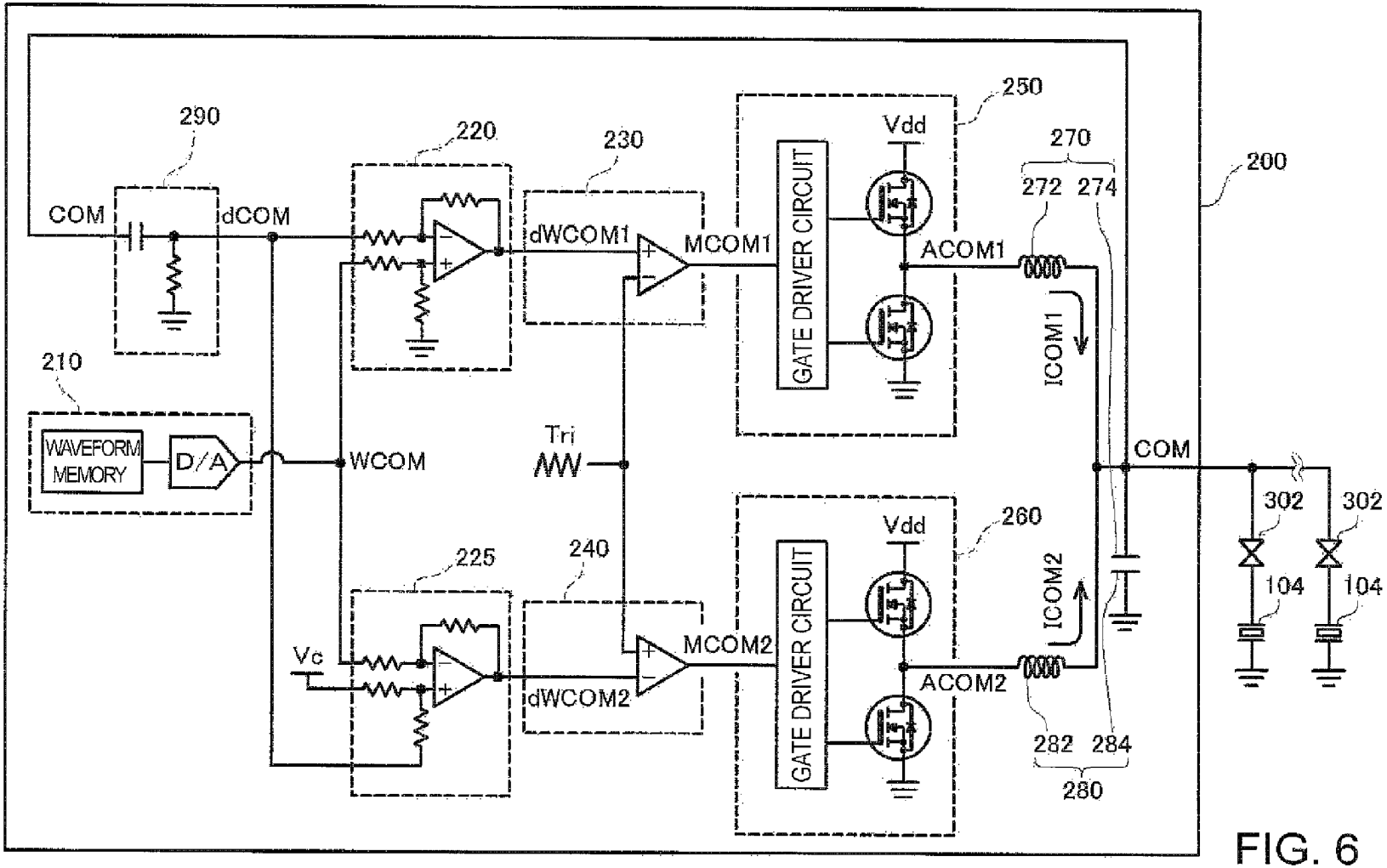
FIG. 6 is an explanatory view showing the detailed configuration of a capacitive load driving circuit of a second embodiment.

FIG. 6 is an explanatory view showing the detailed configuration of a capacitive load driving circuit 200 of the second embodiment. The capacitive load driving circuit 200 of the second embodiment is different from the first embodiment described with reference to FIG. 3 in the configuration for generating MCOM1 and MCOM2 from WCOM. Hereinafter, the capacitive load driving circuit 200 of the second embodiment will be described mainly in terms of this different feature.

As illustrated, the capacitive load driving circuit 200 of the second embodiment includes a drive waveform signal output circuit 210, a first arithmetic circuit 220 and a second arithmetic circuit 225, a first modulator 230 and a second modulator 240, a first digital power amplifier 250 and a second digital power amplifier 260, a first low pass filter 270 and a second low pass filter 280, a compensation circuit 290 and the like.

In the second embodiment, the same triangular wave signal Tri1 is inputted to a negative input terminal of the first modulator 230 and a positive input terminal of the second modulator 240. Consequently, the first modulator 230 and the second modulator 240 output pulse-modulated signals (MCOM1, MCOM2), respectively.

MCOM1, MCOM2 thus outputted are power-amplified by the first digital power amplifier 250 and the second digital power amplifier 260, passed through a coil 272 and a coil 282 and then combined, and applied as COM to a piezoelectric element 104, as in the first embodiment.

Figure 7A:
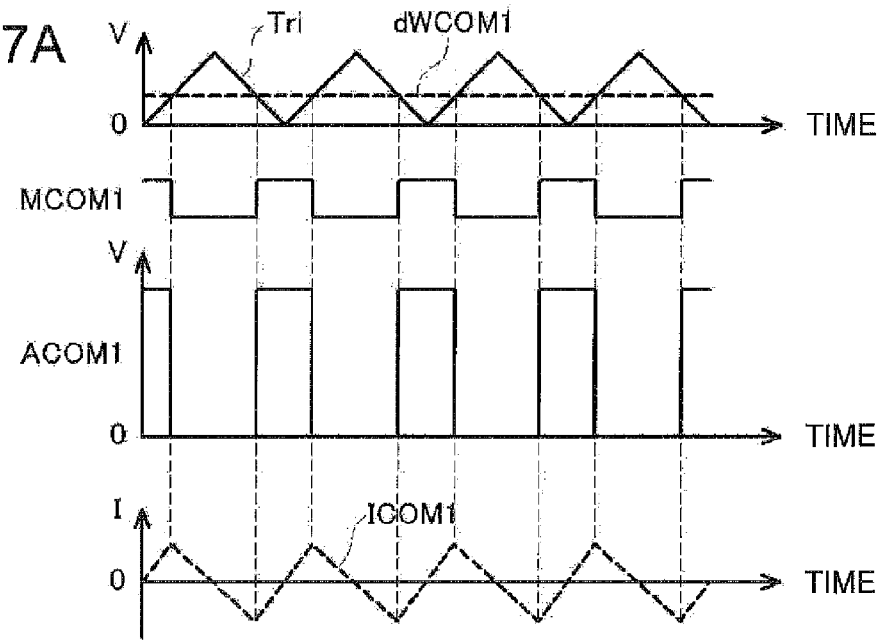
FIGS. 7A to 7C are explanatory views showing the state where the capacitive load driving circuit of the second embodiment combines two demodulated signals to generate a drive signal.
Figure 7B:
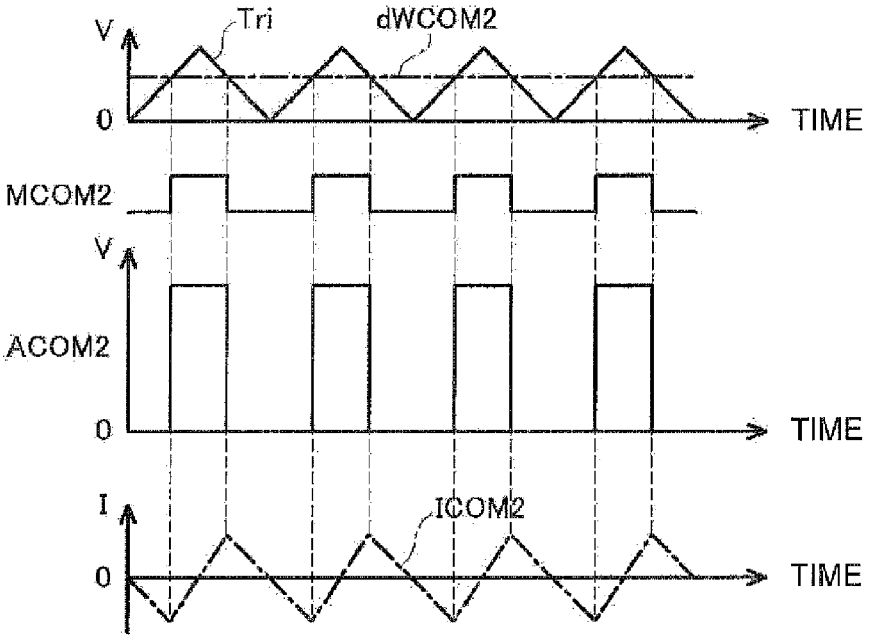
Figure 7C:
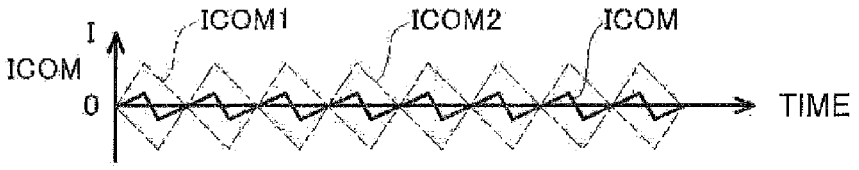

FIGS. 7A to 7C are explanatory views showing the state where the capacitive load driving circuit 200 of the second embodiment combines two demodulated signals to generate COM. FIG. 7A shows the operation of the first modulator 230, the first digital power amplifier 250 and the first low pass filter 270. FIG. 7B shows the operation of the second modulator 240, the second digital power amplifier 260 and the second low pass filter 280. FIG. 7C shows the state where two demodulated signals are combined.

In the second embodiment, the first modulator 230 and the second modulator 240 use the same triangular wave signal Tri1, but dWCOM1 compared with the triangular wave signal Tri1 in the first modulator 230 and dWCOM2 compared with the triangular wave signal Tri1 in the second modulator 240 have voltage values reversed from each other in relation to an intermediate voltage. Therefore, MCOM1 outputted from the first modulator 230 and MCOM2 outputted from the second modulator 240 have waveforms with different phases from each other by 180 degrees. Therefore, as such MCOM1, MCOM2 are power-amplified by the first digital power amplifier 250 and the second digital power amplifier 260 and the resulting ACOM1, ACOM2 are passed through the coil 272 and the coil 282, ripple currents are superimposed on the currents ICOM1, ICOM2 flowing through the coil 272 and the coil 282, as shown in the bottom of FIG. 7A and FIG. 7B.

These ripple currents have different phases from each other by 180 degrees. Therefore, as the current ICOM1 flowing through the coil 272 and the current ICOM2 flowing through the coil 282 are combined, the ripple currents offset each other as shown in FIG. 7C. Thus, the ripple currents can be significantly reduced.

In the first embodiment, the triangular wave signals Tri1, Tri2 having different phases from each other by 180 degrees are used so that the ripple current superimposed on the current ICOM1 flowing through the coil 272 and the ripple current superimposed on the current ICOM2 flowing through the coil 282 have different phases from each other by 180 degrees. However, in the second embodiment, a reverse drive waveform signal that is reversed from dWCOM is generated and dWCOM and the reverse drive waveform signal are compared with the same triangular wave signal Tri1. Thus, the phases of the ripple currents passing through the two coils 272, 282 are made to differ from each other. Generally, reversing dWCOM is easier than generating the triangular wave signals Tri1, Tri2 having different phases from each other by 180 degrees. Therefore, the second embodiment can be realized more easily than the first embodiment.

C. Third Embodiment

In the first embodiment and the second embodiment, WCOM, dWCOM and the like are analog signals, and the series of processing for pulse modulation of dWCOM, which is obtained by negative feedback of dCOM, is described as realized by analog signal processing. However, such processing may be realized by digital signal processing.

Figure 8:
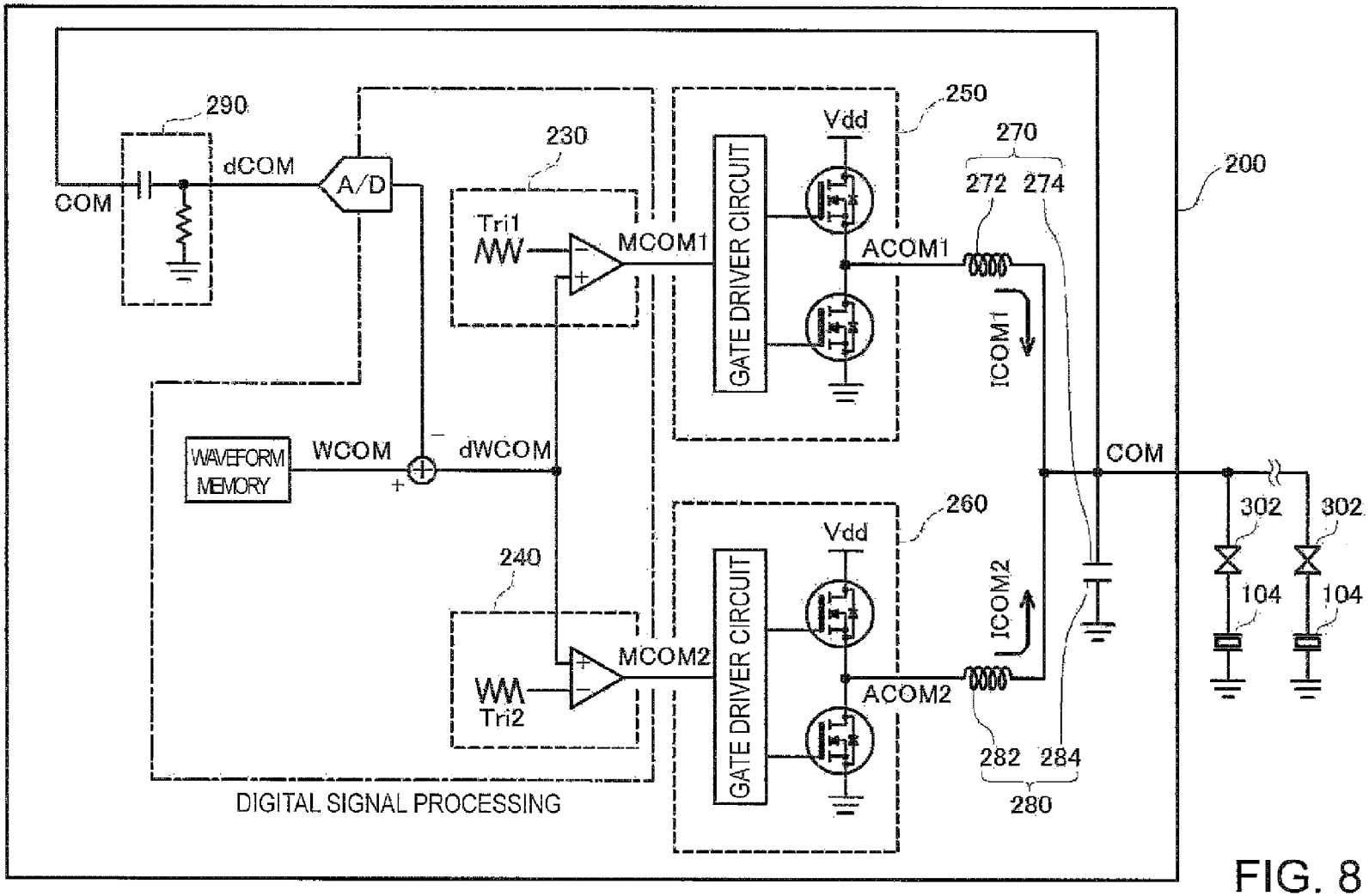
FIG. 8 is an explanatory view showing the detailed configuration of a capacitive load driving circuit of a third embodiment.

FIG. 8 is an explanatory view showing the detailed configuration of a capacitive load driving circuit 200 of a third embodiment. Components similar to those described in the first embodiment are denoted by the same reference numerals as in the first embodiment and will not be described further in detail. In the capacitive load driving circuit 200 of the third embodiment, WCOM is read out directly from a waveform memory, and dCOM converted to digital data by an A/D converter is negatively fed back, thus generating digital data dWCOM. This dWCOM, thus generated, is inputted to a first modulator 230 and a second modulator 240. The first modulator 230 compares a triangular wave signal Tri1 supplied in the form of digital data with dWCOM and thus generates MCOM1. The second modulator 240 compares a triangular wave signal Tri2 supplied in the form of digital data with dWCOM and thus generates MCOM2. After MCOM1, MCOM2 are thus generated, COM is generated and then applied to a piezoelectric element 104, as in the capacitive load driving circuit 200 of the first or second embodiment.

In the capacitive load driving circuit 200 of the third embodiment, the series of processing up to the generation of MCOM1, MCOM2 is realized entirely by digital signal processing. Therefore, it suffices to prepare the triangular wave signals Tri1, Tri2 having different phases from each other precisely by 180 degrees in the form of digital data. Thus, COM can be generated easily.

In the capacitive load driving circuit 200 of the third embodiment, since the triangular wave signals Tri1, Tri2 can be outputted in the form of digital data, the phase difference between the triangular wave signals Tri1, Tri2 can be freely changed. Thus, the phase difference may be changed according to characteristics of the load to be driven. For example, if a large number of nozzles (a large number of piezoelectric elements 104) are to be driven, the capacitance component of the load is large. Therefore, the phase difference between the triangular wave signals Tri1, Tri2 may be decreased to less than 180 degrees to improve a slew rate. On the other hand, if a small number of nozzles (a small number of piezoelectric elements 104) are to be driven and the capacitance component of the load is small, the phase difference may be made close to 180 degrees to reduce the ripple current superimposed on COM. Thus, the capacitive load can be driven more appropriately according to the capacitance component.

D. Modification

In the description of the capacitive load driving circuits 200 of the embodiments, the two modulators, that is, the first modulator 230 and the second modulator 240, are used to generate MCOM1, MCOM2 having different phases from each other. However, MCOM1, MCOM2 having different phases from each other can be generated using one modulator 230 in the following manner. Hereinafter, such a modification will be described. In the following modification, components similar to those described in the first embodiment are denoted by the same reference numerals as in the first embodiment and will not be described further in detail.

Figure 9:
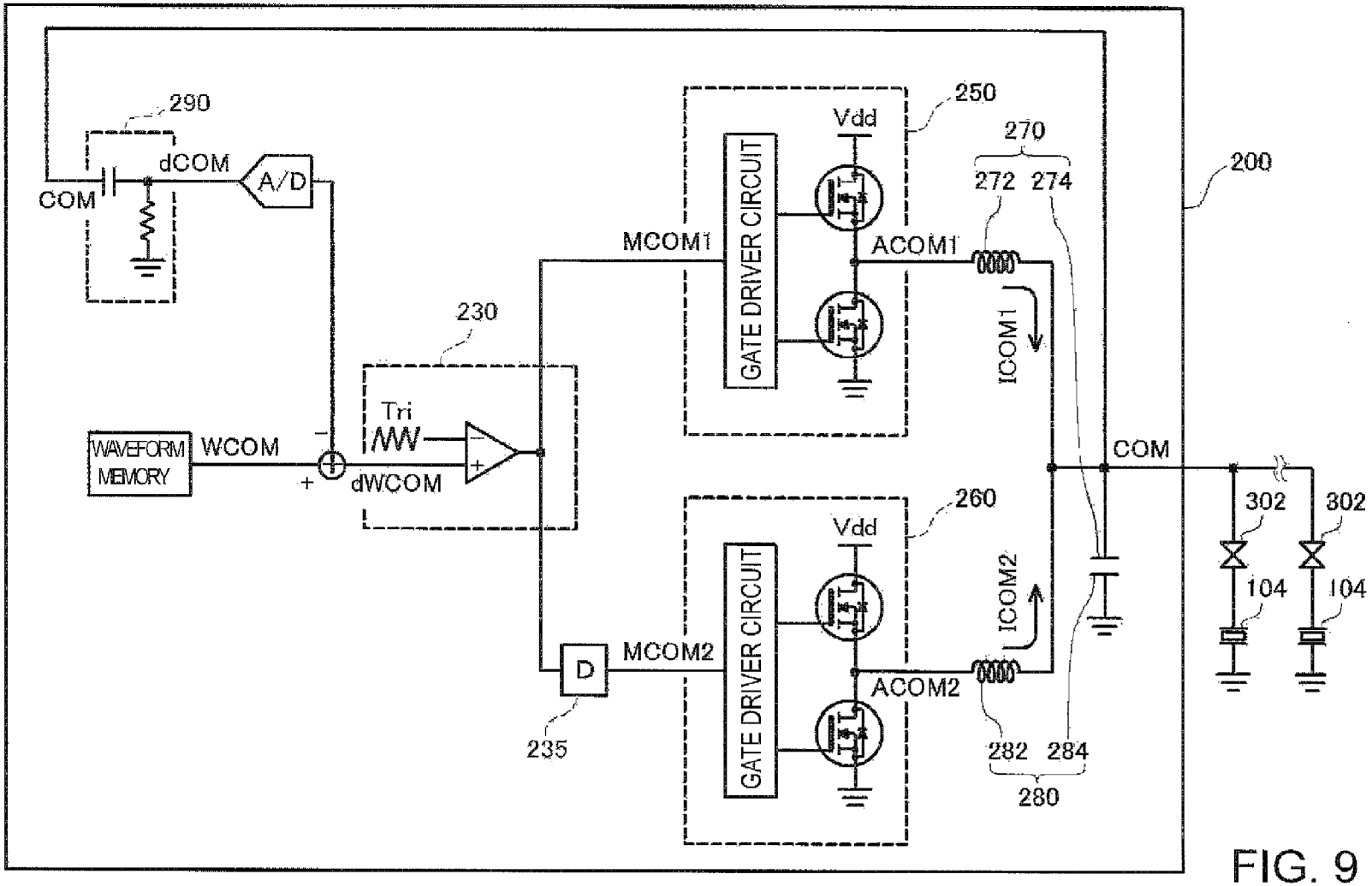
FIG. 9 is an explanatory view showing the detailed configuration of a capacitive load driving circuit according to a modification.

FIG. 9 is an explanatory view showing the detailed configuration of a capacitive load driving circuit 200 according to a modification. In the description of the capacitive load driving circuit 200 of the modification, dWCOM is generated in the form of digital data, and MCOM1 and MCOM2 are outputted by digital signal processing, as in the third embodiment. However, MCOM1 and MCOM2 may be outputted by analog signal processing, as in the first embodiment.

As shown in FIG. 9, in the capacitive load driving circuit 200 of the modification, only one modulator 230 is provided. dWCOM is inputted to a positive input terminal of the modulator 230 and compared with a triangular wave signal Tri inputted to its negative input terminal, thus generating MCOM1. MCOM1, thus generated, is power-amplified by a first digital power amplifier 250, and ACOM1 is outputted. MCOM1 outputted from the modulator 230 is also inputted to a delay circuit 235. The delay circuit 235 delays the inputted waveform by a shorter time period than one cycle of the triangular wave signal Tri. The delayed waveform is inputted as MCOM2 to a second digital power amplifier 260.

By thus delaying MCOM1, MCOM2 having a different phase can be generated. As ACOM1, ACOM2 obtained by power-amplifying these MCOM1, MCOM2 are combined via a coil 272 and a coil 282, COM with reduced ripple can be provided. If the delay time in the delay circuit 235 is set to a half-cycle of the triangular wave signal Tri, the phase of MCOM2 can be delayed by 180 degrees from MCOM1. Therefore, the ripple can be restrained to a minimum level.

In the description of the modification, MCOM 1 obtained by pulse modulation is delayed to generate MCOM2. However, since drive waveform information of each signal is delayed, too, there is a risk that the accuracy of the resulting drive waveform signal may be lowered. Thus, dWCOM1 is delayed to generate dWCOM2 having a different phase from dWCOM1, and each of dWCOM1 and dWCOM2 is pulse-modulated using the same triangular wave signal Tri to generate MCOM1 and MCOM2. After that, MCOM1 is delayed by the same delay time to generate MCOM1, MCOM2 having different phases from each other. Thus, the phases of the drive waveform information are aligned without using the plural triangular wave signals with different phases from each other as described in the first embodiment or the arithmetic circuit for reversing the drive waveform signal WCOM as described in the second embodiment. Therefore, the accuracy of the resulting drive waveform signal can be prevented from being lowered.

Figure 10:
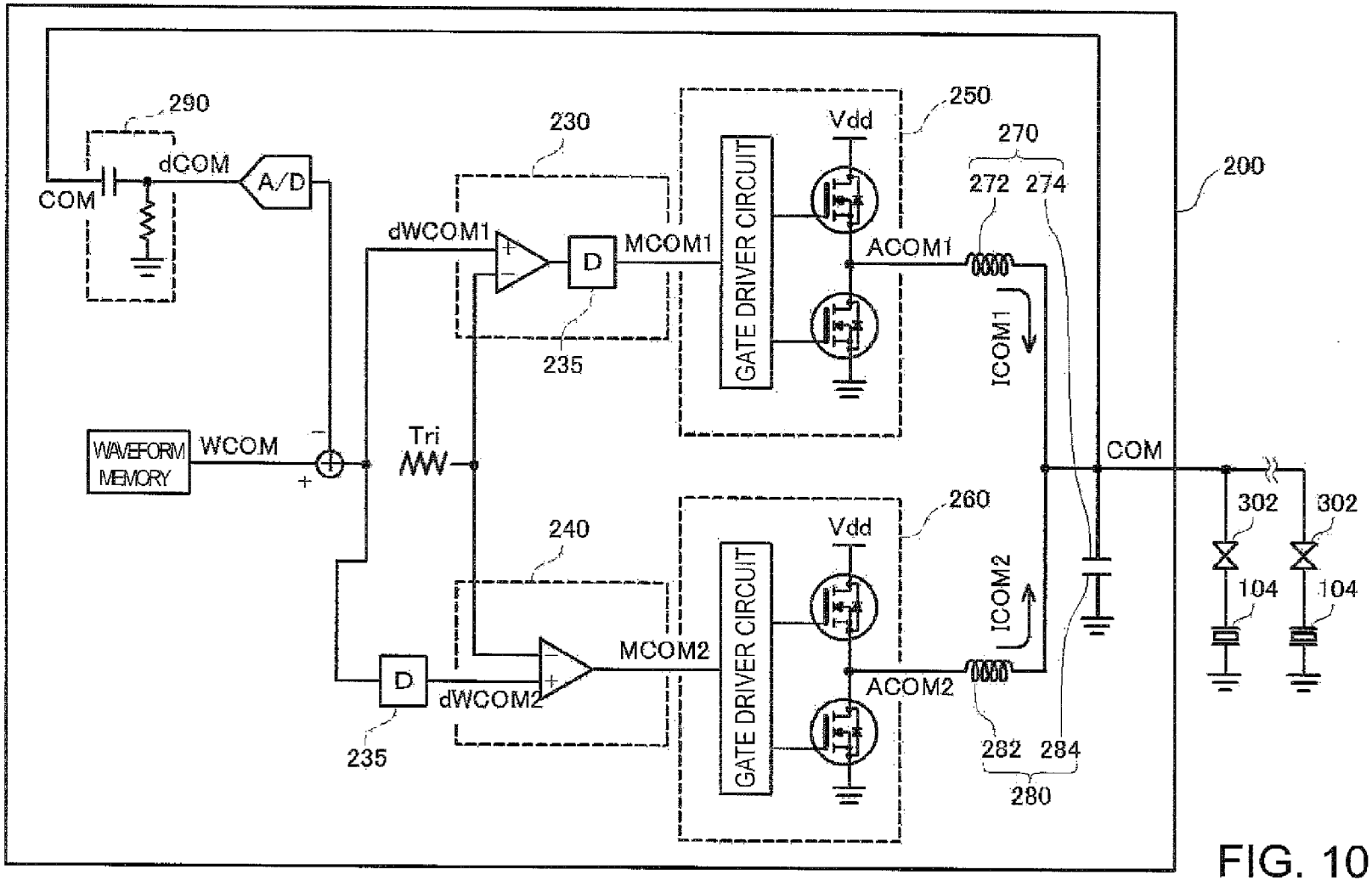
FIG. 10 is an explanatory view showing the detailed configuration of another form of the capacitive load driving circuit of the modification.

FIG. 10 shows the detailed configuration of a capacitive load driving circuit 200 according to another form of the modification. Also in the capacitive load driving circuit 200 of this another form of the modification, dWCOM1, dWCOM2 are described as generated in the form of digital data, as in the third embodiment or the modification. However, dWCOM1, dWCOM2 may be generated as analog data, as in the first embodiment.

In the embodiments and the modification, the capacitive load is described as the piezoelectric element 104 in the ejection head 24. However, the capacitive load to be driven is not limited to the piezoelectric element 104 in the ejection head 24. For example, the above capacitive load driving circuits 200 can be applied to a case where a liquid ejection device which ejects a liquid using a piezoelectric element is driven.

Figure 11:
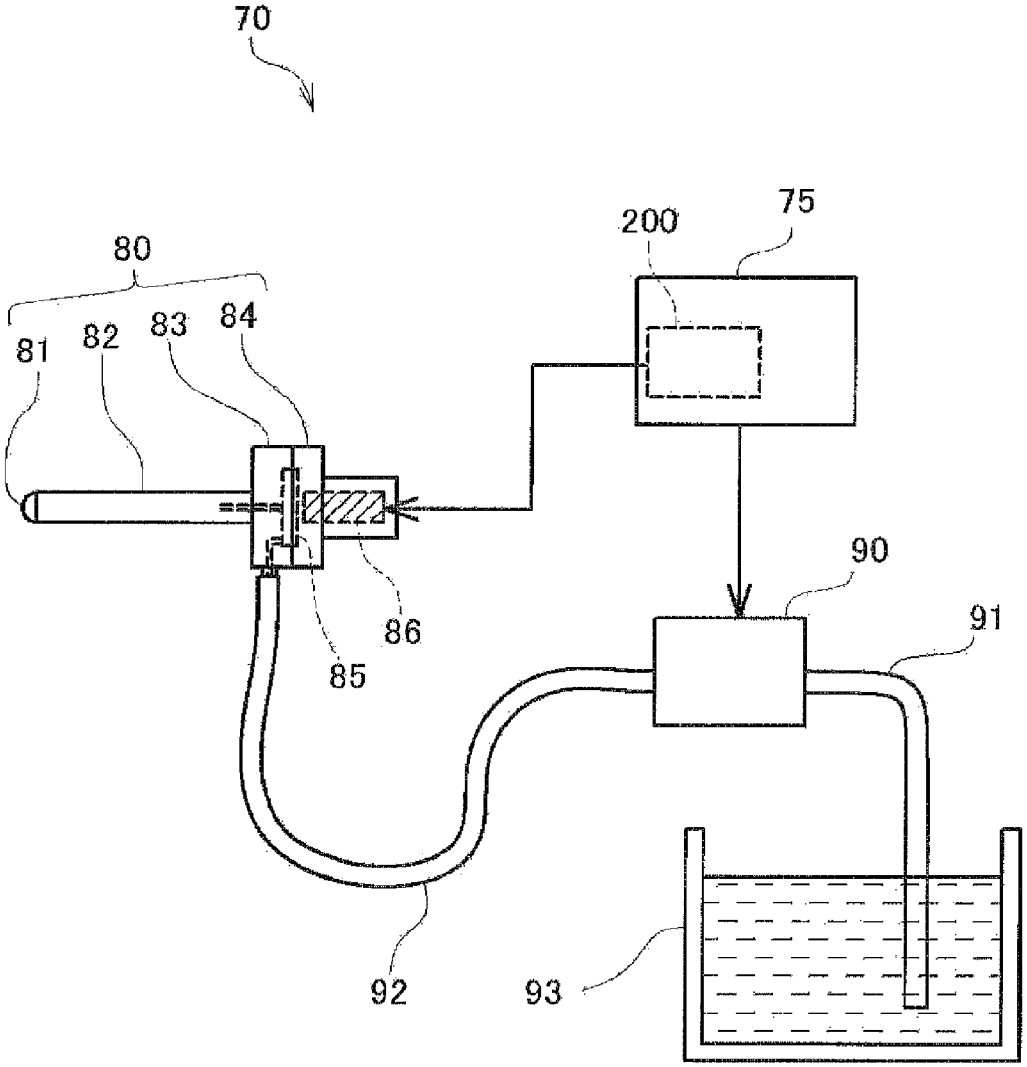
FIG. 11 is an explanatory view showing the schematic configuration of a liquid ejection device which ejects a liquid using a piezoelectric element.

FIG. 11 is an explanatory view showing a schematic configuration of a liquid ejection device 70 which ejects a liquid using a piezoelectric element. As illustrated, the liquid ejection device 70 roughly includes an ejection unit 80 which ejects a liquid in a pulsed form, a liquid supplying unit 90 which supplies, toward the ejection unit 80, the liquid to be ejected from the ejection unit 80, a control unit 75 which controls operation of the ejection unit 80 and the liquid supplying unit 90, and the like.

The ejection unit 80 has a structure such that, on a substantially rectangular-parallelepiped second case 83 made of a metal, a first case 84 which is also made of a metal is superimposed and screwed. A cylindrical liquid ejection tube 82 is provided standing perpendicularly on a front side of the second case 83. A nozzle 81 is inserted in a forward end of the liquid ejection tube 82. A thin circular liquid chamber 85 is provided on a joining face between the second case 83 and the first case 84. The liquid chamber 85 is connected to the nozzle 81 via the liquid ejection tube 82. Inside the first case 84, a piezoelectric element 86 as an actuator is provided. As the piezoelectric element 86 is driven, the liquid chamber 85 can be deformed to change the volume of the liquid chamber 85.

The liquid supplying unit 90 draws up the liquid via a first connecting tube 91 from a liquid container 93 in which the liquid to be ejected (water, physiological saline solution, medical liquid or the like) is stored. After that, the liquid supplying unit 90 supplies the liquid into the liquid chamber 85 of the ejection unit 80 via a second connecting tube 92. The operation of the liquid supplying unit 90 is controlled by the control unit 75. Moreover, a capacitive load driving circuit 200 is provided within the control unit 75. As a drive signal (COM) generated by the capacitive load driving circuit 200 is supplied to drive the piezoelectric element 86, the liquid is ejected in a pulsed form from the nozzle 81 of the ejection unit 80.

In the liquid ejection device 70, too, COM has a waveform including a high frequency component. Therefore, if the capacitive load driving circuits 200 of the embodiments or the modification are used to generate COM, the piezoelectric element 86 can be driven using highly accurate COM with restrained ripple, without unreasonably raising the carrier frequency.

The capacitive load driving circuits of the embodiments and the modification are described above. However, the invention is not limited to all the embodiments and modification and can be carried out in various forms without departing from the scope of the invention. For example, by applying the capacitive load driving circuits of the embodiments to various electronic devices including medical apparatuses such as a liquid ejection device used to form microcapsules in which a medicine or nutritional supplement is encapsulated, a small-size electronic device with high power efficiency can be provided.

This application claims priority to Japanese Patent Application No. 2011-007556, filed on Jan. 18, 2010, the entirety of which is hereby incorporated by reference.

What is claimed is:

1. A control unit for use with an ejection unit and a liquid supplying unit, the control unit is configured to apply a predetermined drive signal to a capacitive load included in the ejection unit and the capacitive load is thus driven to eject a liquid when the control unit is connected with the ejection unit and the liquid supplying unit, the control unit comprising:

a drive waveform signal output circuit which outputs a drive waveform signal to serve as a reference for the drive signal;

a modulator which pulse-modulates the drive waveform signal and thus generates a first modulated signal and a second modulated signal having a different phase from the first modulated signal within a range from greater than 90 degrees to smaller than 270 degrees;

a first digital power amplifier which power-amplifies the first modulated signal and thus generates a first amplified digital signal;

a second digital power amplifier which power-amplifies the second modulated signal and thus generates a second amplified digital signal;

a first low pass filter which performs low pass filtering of the first amplified digital signal and thus generates a first demodulated signal; and a second low pass filter which performs low pass filtering of the second amplified digital signal and thus generates a second demodulated signal;

wherein the first demodulated signal and the second demodulated signal are combined and applied as the drive signal to the capacitive load.

2. The control unit according to claim 1, wherein the modulator generates the first modulated signal by comparing the drive waveform signal with a first triangular wave signal and generates the second modulated signal by comparing the drive waveform signal with a second triangular wave signal having a different phase from the first triangular wave signal.

3. A medical apparatus comprising the control unit according to claim 2.

4. The control unit according to claim 1, wherein the modulator generates the first modulated signal by pulse-modulating the drive waveform signal and generates the second modulated signal by generating a reverse drive waveform signal which is a reverse of the drive waveform signal and then pulse-modulating the reverse drive waveform signal.

5. The control unit according to claim 4, wherein the modulator generates the first modulated signal and the second modulated signal by comparison with the same triangular wave signal.

6. A medical apparatus comprising the control unit according to claim 5.

7. A medical apparatus comprising the control unit according to claim 4.

8. The control unit according to claim 1, wherein the modulator delays the first modulated signal generated by pulse-modulating the drive waveform signal, and thus generates the second modulated signal.

9. A medical apparatus comprising the control unit according to claim 8.

10. The control unit according to claim 1, wherein the modulator generates the first modulated signal by pulse-modulating and subsequently delaying the drive waveform signal, and generates the second modulated signal by delaying and subsequently pulse-modulating the drive waveform signal.

11. A medical apparatus comprising the control unit according to claim 10.

12. A medical apparatus comprising the control unit according to claim 1.

* * * * *